US010597049B2

(12) United States Patent
Harris

(10) Patent No.: US 10,597,049 B2
(45) Date of Patent: Mar. 24, 2020

(54) RAILWAY TRUCK WITH ELASTOMERIC SUSPENSION

(71) Applicant: Amsted Rail Company, Inc., Chicago, IL (US)

(72) Inventor: Zachary Harris, Edwardsville, IL (US)

(73) Assignee: Amsted Rail Company, Inc., Chicago, IL (US)

( * ) Notice: Subject to any disclaimer, the term of this patent is extended or adjusted under 35 U.S.C. 154(b) by 297 days.

(21) Appl. No.: 15/723,380

(22) Filed: Oct. 3, 2017

(65) Prior Publication Data

US 2019/0100223 A1 Apr. 4, 2019

(51) Int. Cl.

| | |
|---|---|
| ***B61F 5/08*** | (2006.01) |
| ***B61F 5/52*** | (2006.01) |
| ***B61F 5/06*** | (2006.01) |

(52) U.S. Cl.

CPC ..... *B61F 5/08* (2013.01); *B61F 5/06* (2013.01); *B61F 5/52* (2013.01)

(58) Field of Classification Search

CPC ..... B61F 5/04; B61F 5/12; B61F 5/06; B61F 5/08; B61F 5/52; B61F 5/305; B61F 5/125; F16F 3/06; F16F 3/10; B60G 11/52

See application file for complete search history.

(56) References Cited

U.S. PATENT DOCUMENTS

| | | | | |
|---|---|---|---|---|
| 127,160 | A * | 5/1872 | Eggleston | B60G 11/52 267/33 |
| 2,242,212 | A * | 5/1941 | Hankins | B61F 5/08 267/292 |
| 2,552,701 | A | 5/1951 | Whithall | |
| 3,628,465 | A | 12/1971 | Dobson et al. | |
| 3,762,694 | A * | 10/1973 | MacDonnell | B61F 5/122 267/3 |
| 3,773,147 | A | 11/1973 | Wiebe | |
| 4,358,096 | A | 11/1982 | Paton et al. | |
| 4,715,290 | A | 12/1987 | Hood, II | |
| 4,841,875 | A | 6/1989 | Corsten et al. | |
| 5,524,551 | A | 6/1996 | Hawthorne et al. | |
| 5,791,258 | A | 8/1998 | Hawthorne et al. | |
| 7,527,003 | B1 | 5/2009 | Schorr et al. | |

OTHER PUBLICATIONS

Polyurethane article—Is Polyurethane Really Better Than Plastic or Rubber?, Feb 7, 2013 (Year: 2013).*

International Search Report and Written Opinion in corresponding International Application No. PCT/US2018/053970, dated Dec. 18, 2018, 10 pages.

* cited by examiner

*Primary Examiner* — Mark T Le

(74) *Attorney, Agent, or Firm* — Amsted Industries Incorporated

(57) ABSTRACT

A railway freight car truck is provided with an elastomeric suspension device between the bolster end and the sideframe spring support surface. The elastomeric device is usually of an elongated oval shape. The elastomeric device takes the place of one or more rows of coil springs that comprise the suspension resting on the sideframe support surface. The freight car truck bolster is supported on the coil springs under empty car conditions and both the coil springs and the elastomeric device under fully loaded car conditions.

10 Claims, 4 Drawing Sheets

RAILWAY TRUCK WITH ELASTOMERIC SUSPENSION

BACKGROUND OF THE INVENTION

Traditional three piece railway freight car trucks are comprised of three basic structural components. These components are two laterally spaced sideframes receiving a bolster extending laterally between the two sideframes. Each sideframe has a central pocket including a bottom support member. A spring group is received on the bottom support member to in turn support the end of the bolster. Snubbing devices such as friction shoes are located between the interface of the sideframe and the sloped faces of the bolster ends to provide damping for oscillations of the spring group. A typical three piece freight car truck with spring groups is shown in U.S. Pat. Nos. 5,524,551 and 5,791,258.

The spring group itself can comprise up to thirteen or more springs each of which is either of a traditional steel coil construction or of a shock absorber type construction. There is a desire among rail freight car builders and operators to decrease the weight of such freight cars to allow a greater weight of material to be hauled.

Accordingly, it is an object of the present invention to improve the spring group interface between the bolster and the sideframe in a railway freight car truck.

SUMMARY OF THE INVENTION

The present invention provides a railway freight car with an improved interface between the bolster and the supporting sideframes. The traditional coil spring arrangement is supplemented with an elastomeric suspension device. The interface may also include a spacer structure or stand to support the elastomeric suspension device. The spacing structure itself usually comprises a cast steel or fabricated steel structural device placed on the bottom support shelf of each sideframe. This spacing structure would include a bottom piece with upward extending walls.

The elastomeric suspension device itself is usually of a generally elongated shape, preferably of an overall oval like or rectangular outward configuration. The elastomeric suspension device of the present invention is meant to be combined with a plurality of coil springs as part of the overall suspension supporting the bolster from the sideframe support surface. The combined coil spring and elastomeric suspension device arrangement is designed to address the two conditions most often experienced by a railway freight car, namely, an empty condition and a fully loaded condition. In an empty car condition, the coil springs alone will support the bolster. In a fully loaded car condition, the coil springs and the elastomeric suspension device will both support the bolster, with the coil springs in a less than fully compressed condition.

DETAILED DESCRIPTION OF THE INVENTION

Figure 1:
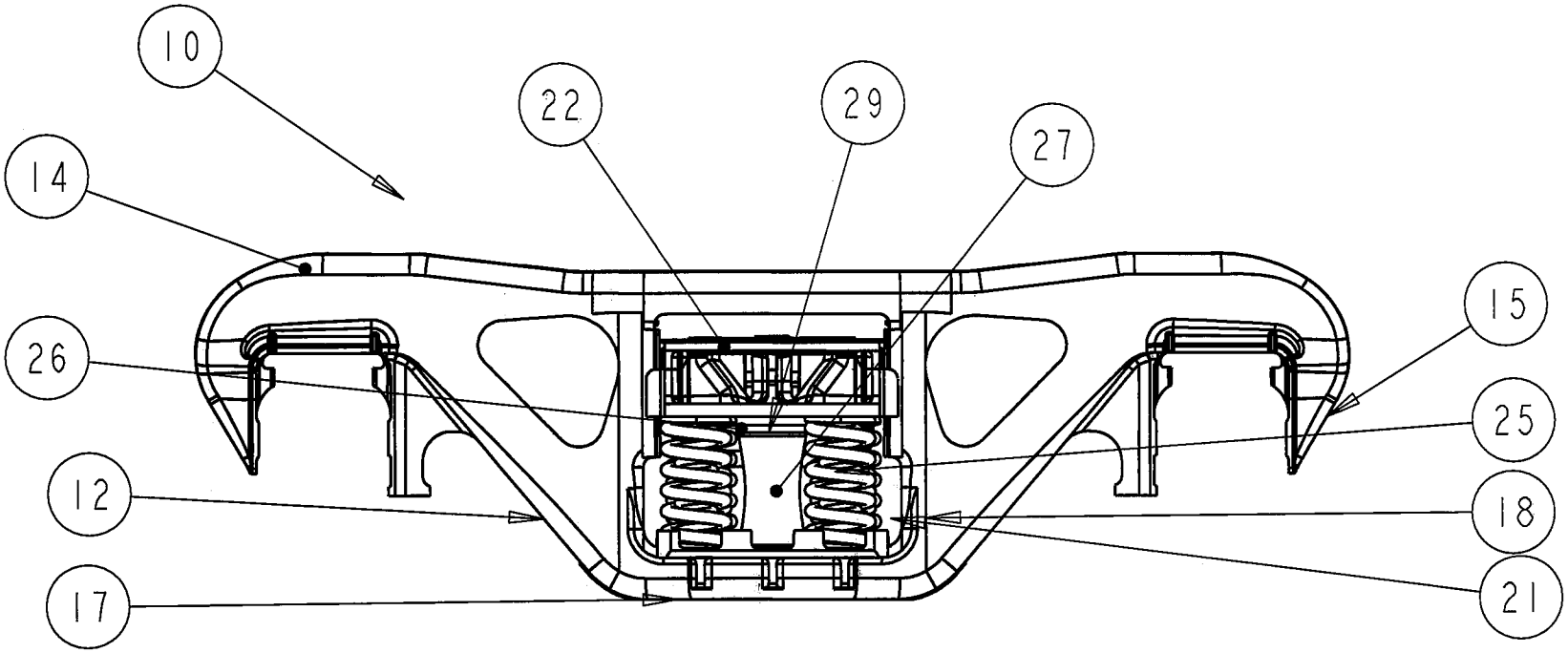
FIG. 1 is a side view of the freight car suspension structure of a first embodiment of the present invention with the bolster end in a sideframe central pocket under an empty car condition.

Referring now to FIG. 1 of the drawings, a side view of a railway truck in accordance with a first embodiment of the present invention is shown generally at 10. Cast steel sideframe 12 is shown with pedestal ends 15 adapted to receive an axle bearing. Sideframe 12 is usually a unitary cast steel structure. Vertical columns 18 extend between bottom support member 17 and compression member 14 to form a central pocket 21 in sideframe 12. It is understood that each railway freight car truck comprises two such sideframes 12 that are spaced laterally from each other.

Bolster 22 is also usually a unitary cast steel structure that extends laterally between sideframes 12. End 27 of bolster 22 includes a lower surface 26. A plurality, usually six or more, of coil springs 25 are supported on the upper surface of sideframe bottom support member 17. Coil springs 25 in turn support bolster end lower surface 26. In this embodiment of the present invention, only coil springs 25 support bolster 22 during an unloaded railcar condition, wherein the railcar associated with truck 10 would be unloaded.

Elastomeric suspension device 27 is a generally elongated oval or rectangular shaped structure having a bottom surface supported on the upper surface of sideframe bottom support member 17. Elastomeric suspension device 27 is usually comprised of a compressible elastomer such as high density urethane. Under unloaded railway car conditions, top surface 29 of elastomeric suspension device 27 would not contact lower surface 26 of bolster 22 and hence not support bolster 22.

Figure 2:
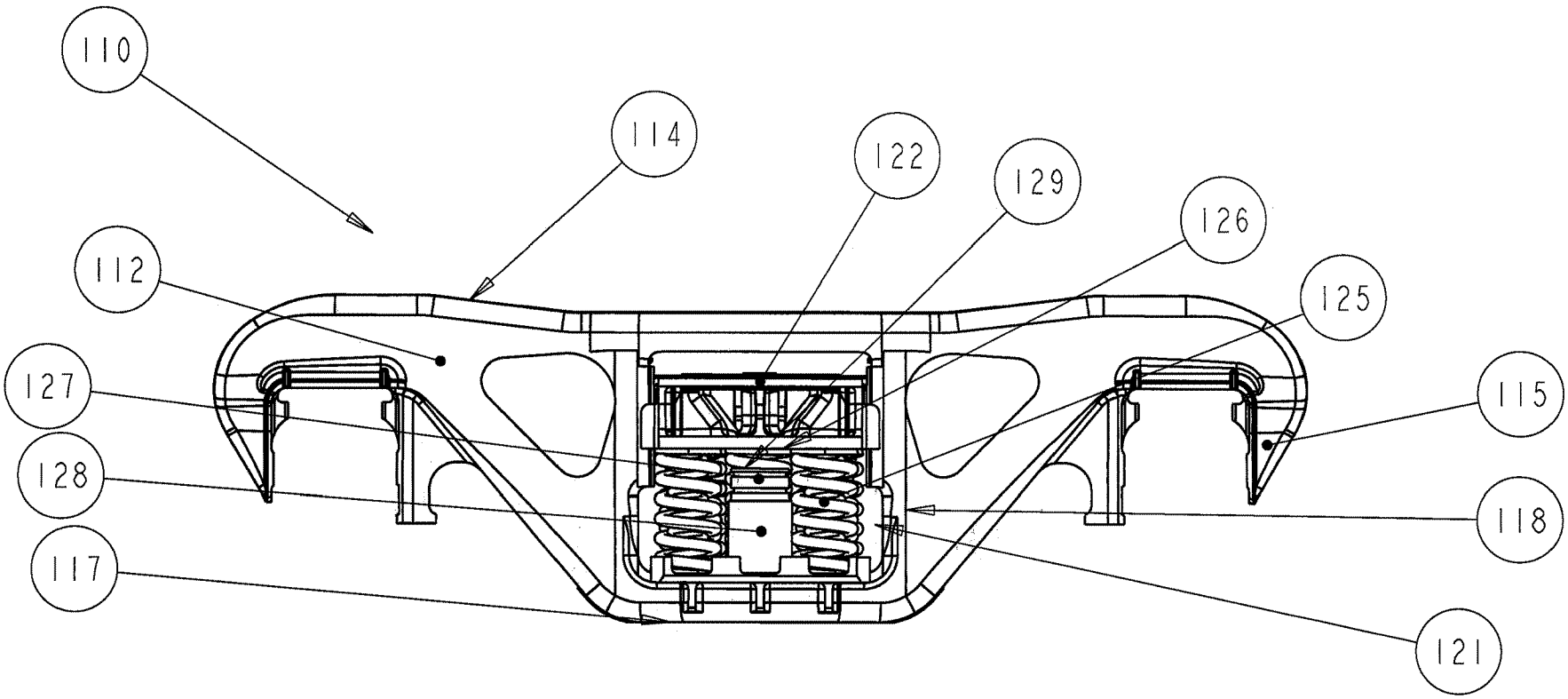
FIG. 2 is a side view of the freight car suspension structure of a second embodiment of the present invention with a bolster end in a sideframe central pocket under an empty car condition.

Referring now to FIG. 2 of the drawings, a side view of a railway truck in accordance with a second embodiment of the present invention is shown generally at 110. Cast steel sideframe 112 is shown with pedestal ends 115 adapted to receive an axle bearing. Sideframe 112 is usually a unitary cast steel structure. Vertical columns 118 extend between bottom support member 117 and compression member 114 to form a central pocket 121 in sideframe 112. It is understood that each railway freight car truck comprises two such sideframes 112 that are spaced laterally from each other.

Bolster 122 is also usually a unitary cast steel structure that extends laterally between sideframes 112. End 127 of bolster 122 includes a lower surface 126. A plurality, usually six or more, of coil springs 125 are supported on the upper surface of sideframe bottom support member 117. Coil springs 125 in turn support bolster end lower surface 126. In this embodiment of the present invention, only coil springs 125 support bolster 122 during an unloaded railcar condition, wherein the railcar associated with truck 110 would be unloaded. Elastomeric suspension device 127 is a generally elongated oval or rectangular shaped structure having a bottom surface placed and supported in a generally elongated oval or rectangular open spacer stand 128. Spacer stand 128 in turn is supported on the upper surface of sideframe bottom support member 117. Elastomeric suspension device 127 is usually comprised of a compressible elastomer such as high density urethane. Under unloaded railway car conditions, top surface 129 of elastomeric suspension device 127 would not contact lower surface 126 of bolster 122 and hence not support bolster 122.

Figure 3:
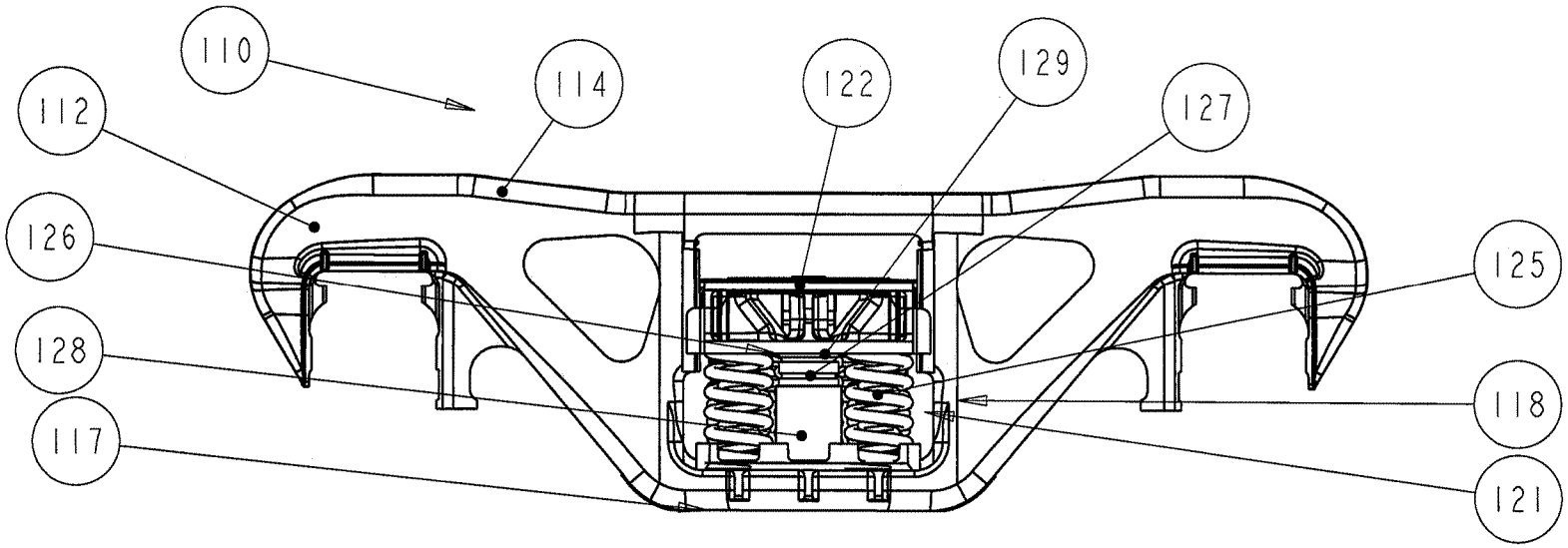
FIG. 3 is a side view of the freight car suspension structure of a second embodiment of the present invention with a bolster end in a sideframe central pocket under a loaded car condition.

Referring now to FIG. 3 of the drawings, a side view of a railway truck in accordance with a second embodiment of the present invention is shown generally at 110. However, this figure depicts the railway car under fully loaded conditions. In such fully loaded condition, top surface 129 of elastomeric suspension device 127 contacts lower surface 126 of bolster 122; elastomeric suspension device 127 would be under compression to a designed amount, usually a compression to about 80 percent of uncompressed vertical height. Hence, elastomeric suspension device 127 would combine with coil springs 125 in supporting support bolster 122. Under fully loaded railcar conditions, coils springs 125 would not be under full compression.

Figure 4:
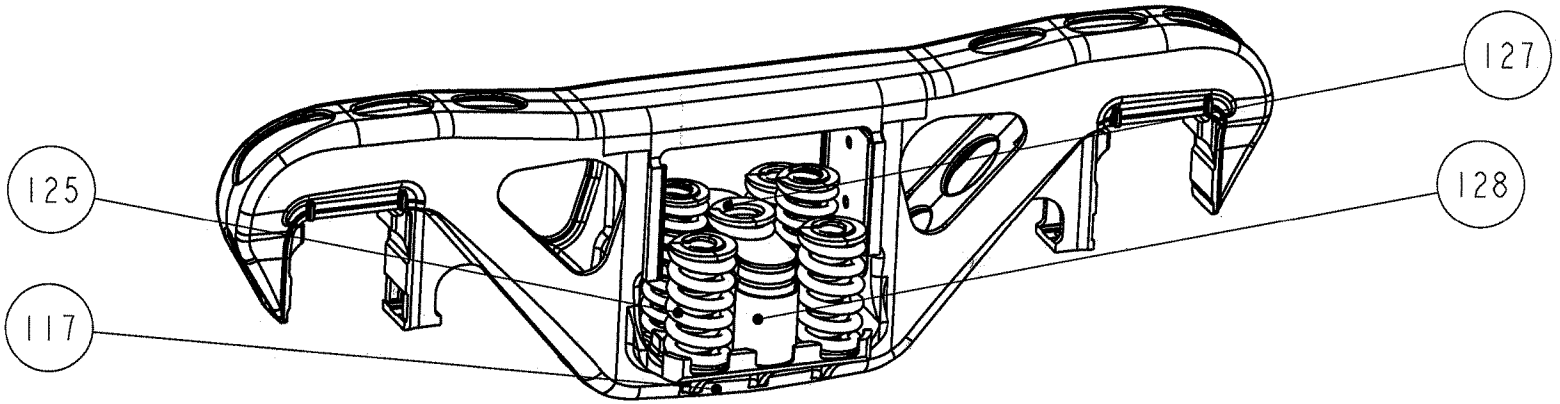
FIG. 4 is a partial perspective view of the freight car suspension structure of a second embodiment of the present invention showing the coil springs and the elastomeric suspension device on the sideframe support surface.

Referring now to FIG. 4 of the drawings, a plurality, usually six or more, of coil springs 125 are supported on the upper surface of sideframe bottom support member 117. Note that each coil spring may be comprised of a coil spring inside a coil spring depending on railway car truck design and loading. Elastomeric suspension device 127 is a generally elongated oval or rectangular shaped structure having a bottom surface placed and supported in a generally elongated oval or rectangular open spacer stand 128. Spacer stand 128 in turn is supported on the upper surface of sideframe bottom support member 117.

Figure 7:
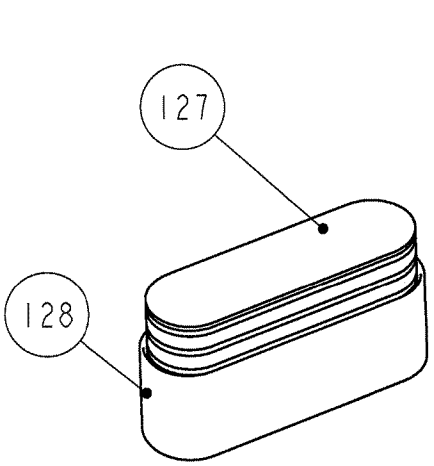
FIG. 7 is a perspective view of an elastomeric suspension device and spacer stand in accordance with a second embodiment of the present invention.
Figure 6:
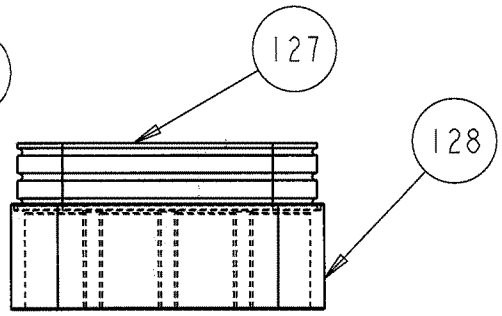
FIG. 6 is a side view of an elastomeric suspension device and spacer stand in accordance with a second embodiment of the present invention.
Figure 5:
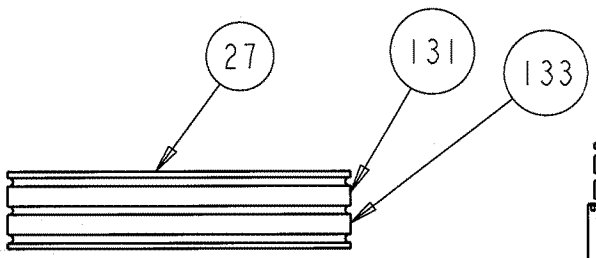
FIG. 5 is a side view of an elastomeric suspension device in accordance with a second embodiment of the present invention.

Referring now to FIGS. 5-7 of the drawings, elastomeric suspension device 127 is a generally elongated oval or rectangular shaped structure having a bottom surface placed and supported in a generally elongated oval or rectangular open spacer stand 128. In turn, spacer stand 128 is supported on an upper surface of sideframe bottom support surface 117. Elastomeric suspension device 127 may be comprised of two or more sections 131 and 133 arranged in a vertical sandwich configuration. Generally elongated oval or rectangular open spacer stand 128 is usually comprised of fabricated steel. Elastomeric suspension device 127 is usually comprised of a compressible elastomer such as a high density urethane material.

Figure 10:
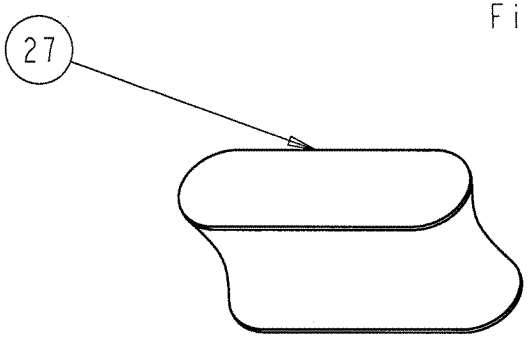
FIG. 10 is a perspective view of an elastomeric suspension device in accordance with a first embodiment of the present invention.
Figure 8:
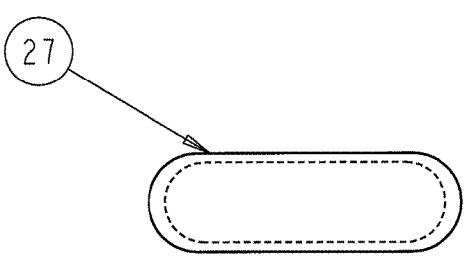
FIG. 8 is a top view of an elastomeric suspension device in accordance with a first embodiment of the present invention.
Figure 9:
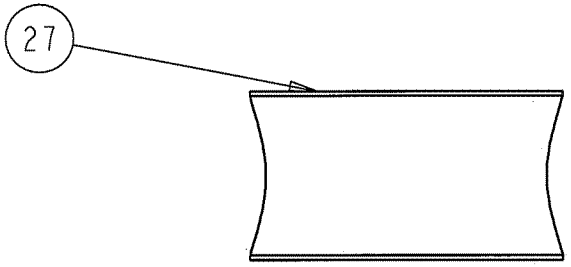
FIG. 9 is a side view of an elastomeric suspension device in accordance with a first embodiment of the present invention.

Referring now to FIGS. 8-10 of the drawings, elastomeric suspension device 27 is a generally elongated oval or rectangular shaped structure having a bottom surface placed and supported on an upper surface of sideframe bottom support surface 17. Elastomeric suspension device 27 may be a unitary structure, or may be comprised of two or more sections arranged in a vertical sandwich configuration. Elastomeric suspension device 27 is usually comprised of a compressible elastomer such as a high density urethane material.

What is claimed is:

1. A railway truck comprising two laterally spaced sideframes, each sideframe having a support surface forming a central pocket, a bolster extending laterally between said sideframes, the bolster having two end sections each of which is received in one of said sideframe central pockets, a plurality of coil springs supported on each sideframe support surface, the coil springs supporting the bolster under unloaded car conditions, an elastomeric suspension device supported on each sideframe support surface, the elastomeric suspension device and the plurality of coil springs supporting the bolster under loaded car conditions, and wherein said elastomeric suspension device comprises a generally elongated oval shaped body, further comprising a spacer stand having a generally elongated oval shape forming an opening, wherein the elastomeric suspension device is received in the opening of the spacer stand.

2. The railway truck of claim 1 wherein the elastomeric suspension device is comprised of a high density urethane material.

3. The railway truck of claim 1 wherein the coil springs are configured to compress to about 80% of their uncompressed length before the bolster contacts the elastomeric suspension device.

4. A railway truck comprising two laterally spaced sideframes, each sideframe having a support surface forming a central pocket, a bolster extending laterally between the sideframes, the bolster having two end sections each of which is received in one of the sideframe central pockets, a plurality of coil springs supported on each sideframe support surface, the coil springs supporting one of the bolster end sections, an elastomeric suspension device supported on each sideframe support surface, the elastomeric suspension device and the plurality of coil springs supporting the bolster under loaded car conditions, and wherein said elastomeric suspension device comprises a generally elongated shaped body, further comprising a spacer stand having a generally elongated oval shape forming an opening, wherein the elastomeric suspension device is received in the opening of the spacer stand.

5. The railway truck of claim 4 wherein the elastomeric suspension device is comprised of a high density urethane material.

6. The railway truck of claim 4 wherein the coil springs are configured to compress to about 80% of their uncompressed length before the bolster contacts the elastomeric suspension device.

7. A railway truck comprising two laterally spaced sideframes, each sideframe having a support surface forming a central pocket, a bolster extending laterally between said sideframes, the bolster having two end sections each of which is received in one of said sideframe central pockets, a plurality of coil springs supported on each sideframe support surface, the coil springs supporting the bolster under unloaded car conditions, an elastomeric suspension device supported on each sideframe support surface, the elastomeric suspension device and the plurality of coil springs supporting the bolster under loaded car conditions, and wherein said elastomeric suspension device comprises a generally elongated oval shaped body, wherein the coil springs are configured to compress to about 80% of their uncompressed length before the bolster contacts the elastomeric suspension device.

8. The railway truck of claim 7 wherein the elastomeric suspension device is comprised of a high density urethane material.

9. A railway truck comprising two laterally spaced sideframes, each sideframe having a support surface forming a central pocket, a bolster extending laterally between the sideframes, the bolster having two end sections each of which is received in one of the sideframe central pockets, a plurality of coil springs supported on each sideframe support surface, the coil springs supporting one of the bolster end sections, an elastomeric suspension device supported on each sideframe support surface, the elastomeric suspension device and the plurality of coil springs supporting the bolster under loaded car conditions, and wherein said elastomeric suspension device comprises a generally elongated shaped body, wherein the coil springs are configured to compress to about 80% of their uncompressed length before the bolster contacts the elastomeric suspension device.

10. The railway truck of claim 9 wherein the elastomeric suspension device is comprised of a high density urethane material.

* * * * *